United States Patent [19]

Bünger

[11] Patent Number: 4,761,945

[45] Date of Patent: Aug. 9, 1988

[54] WEIGHTING CORD FOR CURTAINS, DRAPES AND THE LIKE

[75] Inventor: Claus M. Bünger, Wuppertal, Fed. Rep. of Germany

[73] Assignee: August Bünger Bob-Textilwerk KG. GmbH & Co., Wuppertal, Fed. Rep. of Germany

[21] Appl. No.: 874,162

[22] PCT Filed: Oct. 3, 1985

[86] PCT No.: PCT/EP85/00514

§ 371 Date: Jun. 6, 1986

§ 102(e) Date: Jun. 2, 1986

[87] PCT Pub. No.: WO86/01987

PCT Pub. Date: Apr. 10, 1986

[30] Foreign Application Priority Data

Oct. 6, 1984 [DE] Fed. Rep. of Germany ..... 3436801

[51] Int. Cl.[4] ..... A47H 23/01; D02G 3/44

[52] U.S. Cl. ..... 57/224; 57/5; 57/210; 87/6; 160/349.1

[58] Field of Search ..... 57/3, 5, 6, 210, 224; 87/6, 8; 160/349 R, 349 D

[56] References Cited

U.S. PATENT DOCUMENTS

| | | | |
|---|---|---|---|
| 1,050,748 | 1/1913 | Paulsson | 87/6 |
| 3,259,151 | 7/1966 | Schmitz | 160/349 X |
| 3,400,628 | 9/1968 | Herzog | 87/6 |
| 3,623,397 | 11/1971 | Hayashi et al. | 87/6 |
| 3,684,608 | 8/1972 | Schmitz et al. | 160/349 X |
| 4,209,965 | 7/1980 | Bobkowicz | 57/5 |

FOREIGN PATENT DOCUMENTS

| | | | |
|---|---|---|---|
| 364292 | 10/1981 | Austria . | |
| 962192 | 4/1957 | Fed. Rep. of Germany | 160/349 |
| 1189686 | 3/1965 | Fed. Rep. of Germany . | |
| 2432580 | 1/1976 | Fed. Rep. of Germany | 160/349 |

*Primary Examiner*—John Petrakes

*Attorney, Agent, or Firm*—Peter K. Kontler

[57] ABSTRACT

In order to incorporate a weighting cord into the curtain without hindrance, not only is a bead array of spaced weighting bodies employed but this bead array is also surrounded by a textile tube which is to provide a cord surface substantially free of discontinuities. To produce the weighting cord economically, it is proposed to make it as a yarn composite using a spinning procedure. Here, the bead array constitutes a yarn core extending in axial direction of the yarn, and spun fibers are wound around the yarn core thereby generating a tube-like spun fiber coat.

8 Claims, 1 Drawing Sheet

WEIGHTING CORD FOR CURTAINS, DRAPES AND THE LIKE

Figure 1:
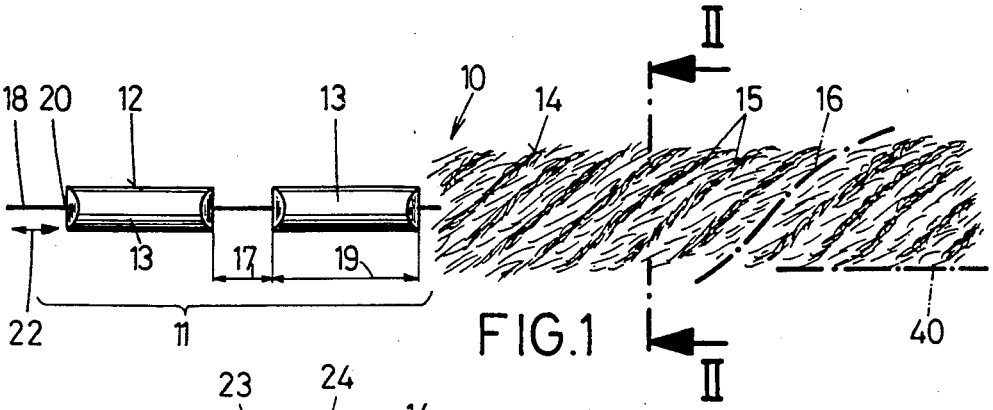

The invention relates to a weighting cord of the type set forth in the generic portion of claim 1 and disclosed in the German Auslegeschrift No. 11 89 686.

For the weighting of curtains, there exist bare arrays of beads (German Pat. No. 962 192) which include a row of spaced lead beads arranged one behind the other on a central carrier string. These weighting means provide adequate weight in a small amount of space and, due to the free spaces between them, are sufficiently flexible for unhindered pleating. However, processing of the bead arrays poses difficulties because the front ends of the lead beads catch while the array of beads is being inserted or worked in. This cannot be entirely avoided by providing the ends of the individual lead beads with inclined or rounded surfaces in order to achieve smooth insertion, especially since such special shaping of the individual lead beads is expensive. Another drawback of these known arrays of beads is that the spaces between the individual lead beads are not adequately maintained; the lead beads can shift relative to one another on the central carrier string. This leads to a non-uniform weight distribution, and hence to varying weighting effects in the thus-equipped curtain.

The enumerated drawbacks in weighting cords of the preceding type are avoided by means of a tube which surrounds the array of beads (German Auslegeschrift No. 11 89 686). The tube bridges the free spaces between the weighting bodies without significantly affecting the flexibility of the bead array during pleat formation. The tube also creates an essentially uninterrupted cord surface which makes it possible to work the weighting cord into the curtain or to draw the cord into the border of the curtain smoothly and without hindrance. Furthermore, a tube which surrounds and, in particular, tightly surrounds, the array of beads maintains the desired spacing of the weighting bodies relative to one another and prevents their inadvertent displacement during incorporation into the curtain or during use of the curtain. The exterior textile character of such weighting cords is likewise favorable because they optically better match the curtain equipped therewith. There are, however, other drawbacks.

Thus, the production of a textile tube for weighting cords of this type is very expensive. The textile tube for the known weighting cords is produced by the crisscrossing of fibers in a braiding operation where the supply reels, which respectively hold only limited lengths of the individual fibers, are intertwined with one another on a complicated braiding machine in accordance with the desired braid pattern. Even with very fast, and hence trouble prone, braiding machines, the textile tube can be produced at a rate of only a few centimeters per minute. This results in a relatively high price for the weighting cords.

It has been recognized that the production of the textile tube for such weighting cords leads to high manufacturing costs (German Offenlegungsschrift No. 24 32 580). However, it was then considered necessary to dispense with the production of a textile tube and to strew the array of beads, that is, the lead beads as well as the carrier string which is visible in the free spaces, with a flock yielding a bristle-like coat. While these bristles do hold against sliding at the locations of contact with the curtain, the elimination of the tube raises the possibility of catching of the flock-coated bead array during incorporation into the curtain or during drawing into the finished curtain. This danger cannot be avoided by roof-shaped front surfaces at the ends of the lead beads which surfaces, as already mentioned, incur additional production costs. Sufficient amounts of the flock do not reach the exposed portions of the central carrier string which lie between neighboring lead beads so that longitudinal shifting of the lead beads on the carrier string during incorporation into the curtain or during use of the curtain cannot be ruled out.

The object of the invention is to provide a weighting cord of the type described which can be readily incorporated into the curtain or drape and which is particularly economical to manufacture because the ends of the lead beads do not require a special profile and the textile tube can be produced rapidly.

According to the invention, this is achieved by the features set forth in the claims. The invention has recognized for the first time that the textile tube-like covering may be produced most simply and rapidly as yarn by means of a spinning process. An array of beads is used as a core element for production of the yarn. The individual fibers of a yarn good are placed about this core element and, together with the bead array, form a yarn assemblage, that is, a spun filament. The so-called open end friction spinning procedure (see Sonderdruck aus Chemiefasern/Textilindustrie 33/85, September 1983, 570/580) has been found to be very suitable for the invention and, per the recognition of the invention, can be employed for the production of weighting cords of the type described. Here, spun fibers which have been separated in an air current are, according to the invention, directed onto an array of beads which functions as a core for yarn and is wound with individual fibers. The fibers placed about the array of beads form a satisfactory textile tube which bridges the gaps between neighboring weighting bodies and thus creates an essentially uninterrupted cord surface. This makes it possible to incorporate the weighting cord into the curtain or the drape without hindrance. Due to the smooth tube, catching of the weighting cord need not be feared when incorporating the weighting cord during manufacture of the curtain or drape, or when inserting the weighting cord in a seam of a prefabricated curtain. Moreover, the spinning in accordance with the invention assures an extraordinarily reliable positioning of the individual weighting bodies in the bead array because individual fibers are naturally also deposited in the free spaces and there create a "plug" in the tube which essentially prevents any longitudinal displacement of the individual weighting bodies. This high degree of positioning does not, however, necessarily cause a correspondingly large constriction at the surface of the textile tube as is, of necessity, the case in the known textile tubes produced by braiding. The spun fibers at the surface of the yarn assemblage according to the invention nevertheless adequately increase the friction relative to a curtain equipped with this cord so that there is no need to fear shifting of the cord in the border of the curtain containing the same during normal use of the curtain when it is opened or closed in front of windows or doors.

The production of the textile tube equipped weighting cord according to the invention as "yarn" is characterized by being extraordinarily economical and rapid. As has been found in practice, the invention makes it possible, without difficulty, to achieve production rates ten times, and even one hundred times, those of the known braiding procedure for the production of textiles. This is achieved, in particular, with the special production method constituting part of the invention and set forth in more detail in method claims. At least two running endless bands may here be used as friction elements. In practice, two screening drums rotating in the same sense have proved suitable as friction elements. The locations of contact with the bead array lie in their wedge region, and the transporting medium with the separated fibers of the yarn good is blown through.

The outer spin fiber coat of the weighting cord produced in this manner is already sufficiently strong. Even in the absence of special twisting, the individual fibers of the outer spun fiber coat adhere to one another with sufficient strength; their ends are hooked together. Without twisting, the weighting cord according to the invention is externally like a cotton strand. However, a strengthening of the coat results from additional twisting which can be achieved by stranding the weighting cord obtained in accordance with the invention.

Additional or alternative means may be employed to strengthen the outer coat of spun fibers, e.g., placing one or more strands about the outer side. These strands can consist of discrete filaments, filamentary yarns or yarns of spun fibers. The placing of the strands may involve simple winding or braiding, which can be accomplished with a larger pitch, or may be effected by stitching. Adhesives may also be used for strengthening, or connections established by fusion when at least one component of the fibers consists of a thermoplastic material. Such an ability to be fused can finally likewise be used to connect the finished weighting cord with curtains or drapes, e.g., by ironing.

Due to its rapid and economical production, the tube of the weighting cord according to the invention may, as regards material and color, always be matched to the appearance of the curtain or drape. In particular, it suffices here to design only the outermost layer of the tube in this manner because, in accordance with a further proposal of the invention, the tube of the weighting cord is composed of a plurality of superimposed layers formed of fibers of different materials. This allows a further reduction in the cost of material to be achieved since less expensive fiber materials may be used in the inner zones which are not visible from the outside than in the outer layers. A pattern may also be produced on the weighting cord in this manner. From a method standpoint, this may be readily accomplished by blowing fibers of different materials and/or different lengths and/or different composition along the path of contact of the bead array and the rotating friction elements. The inner layers of the spun fiber coat are formed in the initial portion of this contact path whereas the outermost layers are formed in the last section of the contact path. This allows the inner structure of the tube in the weighting cord of the invention to be controlled.

Figure 2:
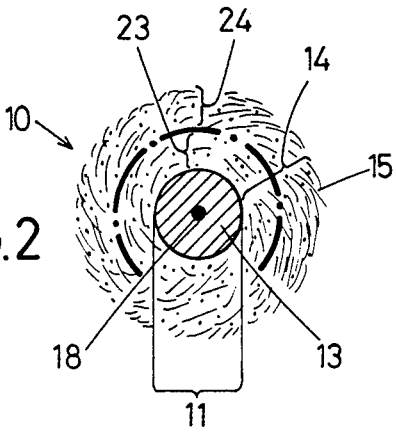
Figure 3:
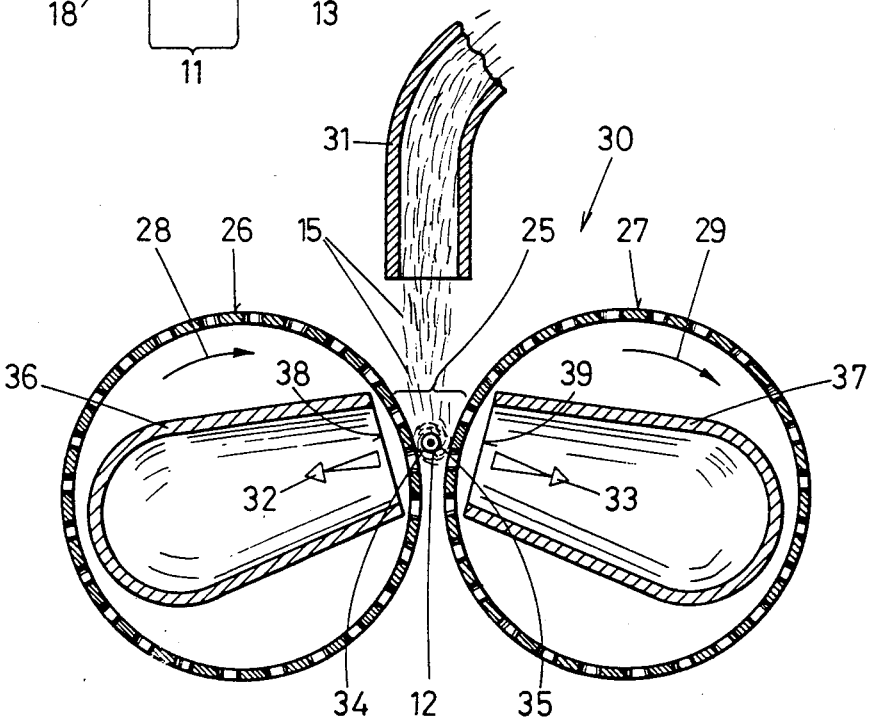

An exemplary embodiment of the invention is illustrated in the drawings. These show:

FIG. 1 is a greatly enlarged side view of a longitudinal section of the weighting cord in accordance with the invention with a portion of the textile tube removed, FIG. 2 is a cross-sectional view, with even greater enlargement than FIG. 1, through the weighting cord of the invention along the section line II—II of FIG. 1, and FIG. 3 schematically illustrates an arrangement for producing the weighting cord according to the invention.

The weighting cord 10 in accordance with the invention is produced like a yarn by a spinning procedure. It includes a yarn core 11 constituted by a bead array 12 of spaced weighting bodies 13 arranged in a line one behind the other, and an outer spun fiber coat 14 of individual fibers 15 of a yarn good which are helically wound about the yarn core 11. The course of the windings is indicated in FIG. 1 by the thick phantom line 16.

The bead array 12 here has a special structure because a carrier string 18 passing through a central bore of the weighting bodies 13 functions to maintain the weighting bodies 13 at a desired spacing 17. The weighting bodies 13 consist of sections of predetermined length 19, and their ends 20 may be formed simply by the cuts used for subdivision without special shaping thereby allowing the bead array 12 to be produced in a simple manner. The spaces 21 between neighboring weighting bodies 13 impart flexibility to the weighting cord 10.

After production of the weighting cord 10 like yarn by a spinning procedure, the individual fibers 15 are also present in the free spaces 17 between neighboring weighting bodies 13 and form a plug therein. The spun fiber coat 14 in the weighting cord of the invention thus constitutes a tube having inwardly directed plugs which are diposed between the weighting bodies 13 and prevent longitudinal displacement of the weighting bodies on the central carrier string 18 in the directions of the arrow 22 shown in FIG. 1.

The spun fiber coat 14 can be formed from fibers of any material and any length which are stranded with one another about the yarn core 11 in a yarn-like fashion. Layers of different materials may be used in the spun fiber coat 14 without significantly increasing the production cost of the weighting cord 10 according to the invention. Thus, as indicated by the dash-and-dot boundary line in FIG. 2, an inner layer 23 may be formed of less expensive fiber material without affecting the function and appearance of the outer layer 24 formed of more suitable fiber material. Per the invention, it is, of course, also possible for the interior of the weighting cord 10 in accordance with the invention to be provided with a bead array 12 in which the individual weighting bodies 13 are not held together by a carrier string 18; for example, a different type of carrier, e.g., an adhesive band, on which the individual weighting bodies 13 are arranged at the desired distance from one another can be used. Further, it is basically possible to dispense with a connecting carrier string 18 since the position and location of the weighting bodies are fixed by the mentioned plug within the spun fiber coat 14.

It is evident from FIG. 3 that a previously prepared bead array 12 is used to start and, as may be seen from the sectional view of FIG. 3, is conveyed through the region 25 of a wedge between two adjacent screening drums 26,27 in the direction of the drum axes. As can be observed from the arrows 28,29, the two screening drums 26,27 are advantageously rotated in the same sense. The screening drums 26,27 belong to an arrangement 30 of a so-called open end friction spinning apparatus in which, in a manner not illustrated in FIG. 3, a fibrous band or a roving is broken down in a stretching machine and conveyed to the mentioned wedge region 25 through a channel 31. An air current is advantageously used as a carrier medium for this purpose and flows in the directions of the illustrated flow arrows 32,33 from the wedge region 25 into the interiors of the two screening drums 26,27 thereby depositing the separated fibers 15 on the suction surfaces of the two screening drums 26,27.

In the wedge region 25, contacts 34,35 shown in FIG. 3 are now established between the deposited fibers 15 and the bead array which, as already indicated, is continuously advanced through the wedge region 25 parallel to the drum axes by a non-illustrated take-up device. The bead array 12 is accordingly rotated thereby stripping the individual fibers 15 from the drums 26,27, and the individual fibers 15 are twisted about the bead array 12, that is, wound in approximately helical form due to the longitudinal movement of the bead array 12. The bead array 12 can acquire a so-called "false thread" where the twist imparted to the traveling longitudinal section in the region of the drums 26,27 is again reversed in the following portion of the finished weighting cord extending to the take-up device. The twist can, however, be maintained thereby resulting in a strengthening of the surface.

The flow 32,33 of air laden with individual fibers 15 to the drums 26,27 is, as shown in FIG. 3, generated by suction conduits 36,37 which are located in the drum interiors and have conduit openings 38,39 facing the mentioned wedge region 25.

It will be understood that other rotating friction elements such as, for example, endless bands, laths or the like, may be used instead of the screening drums 26,27 to coil the spun fibers. Also, fibers 15 of different composition may flow in the air current along the mentioned contact locations 34,35 with the screening drums 26,27 or the analogous friction elements. This results in the mentioned varying layered structure of the spun fiber coat 14 in the yarn-like weighting cord 10 according to the invention. As is illustrated in FIG. 1 by the dash-and-dot boundary line 40, the cord surface defined by the spun fiber coat 14 is free of discontinuities in the finished weighting cord 10. This is due to the "plugs" which have already been mentioned several times and are located in the free spaces 17 between the weighting bodies 13. Accordingly, a smooth, unhindered passage of the weighting cord 10 during its incorporation is achieved.

I claim:

1. A weighting cord for curtains, drapes and the like, comprising a flexible core including a file of neighboring weighting bodies and having spaces between the neighboring weighting bodies; and a tube of helically spun fibers, said tube surrounding said core and having portions extending into and at least substantially filling said spaces to form plugs which oppose movements of said weighting bodies toward and away from each other.

2. The cord of claim 1, wherein said tube has a plurality of layers containing different fibers.

3. The cord of claim 2, wherein at least one of said layers is reinforced.

4. The cord of claim 1, wherein at least some fibers of said tube are adhesively connected to each other.

5. The cord of claim 1, wherein at least some fibers of said tube are fused to each other.

6. The cord of claim 1, wherein at least some fibers of said tube consist of a thermoplastic material.

7. The cord of claim 1, further comprising means for reinforcing the tube, including at least one strand of fibers surrounding said tube.

8. The cord of claim 1, wherein said flexible core further comprises a carrier string for said weighting bodies.

* * * * *